US009266640B2

(12) United States Patent
Jensen

(10) Patent No.: US 9,266,640 B2
(45) Date of Patent: Feb. 23, 2016

(54) RETAIL BOXES AND METHOD OF MANUFACTURING RETAIL BOXES

(76) Inventor: Jarl Jensen, Nyack, NY (US)

( * ) Notice: Subject to any disclaimer, the term of this patent is extended or adjusted under 35 U.S.C. 154(b) by 1121 days.

(21) Appl. No.: 13/234,728

(22) Filed: Sep. 16, 2011

(65) Prior Publication Data

US 2012/0085813 A1 Apr. 12, 2012

Related U.S. Application Data

(63) Continuation-in-part of application No. 12/463,883, filed on May 11, 2009, now Pat. No. 8,037,663.

(60) Provisional application No. 61/080,237, filed on Jul. 12, 2008.

(51) Int. Cl.

| | |
|---|---|
| ***B65D 5/32*** | (2006.01) |
| ***B65D 5/42*** | (2006.01) |
| ***B31B 17/00*** | (2006.01) |

(52) U.S. Cl.

CPC ..... *B65D 5/4279* (2013.01); *B31B 17/00* (2013.01); *B65D 5/321* (2013.01); *B65D 5/324* (2013.01); *B31B 2217/086* (2013.01)

(58) Field of Classification Search

CPC ..... B65D 5/4279; B65D 5/324; B65D 5/321
USPC ..... 229/125.19, 122.21, 122.32, 122.33, 229/122.34, 5.84
See application file for complete search history.

(56) References Cited

U.S. PATENT DOCUMENTS

| | | | | |
|---|---|---|---|---|
| 618,468 | A * | 1/1899 | Knobeloch | 229/122.34 |
| 1,863,259 | A * | 6/1932 | Van Buren | 229/122.21 |
| 1,997,718 | A | 4/1935 | Claff | |
| 2,332,652 | A | 10/1943 | Mackenzie | |
| 2,411,622 | A * | 11/1946 | Guyer et al. | 229/132 |
| 2,706,592 | A * | 4/1955 | Schaller | 229/109 |
| 3,007,622 | A * | 11/1961 | George | 229/122.21 |
| 3,172,593 | A * | 3/1965 | Potter | 229/5.84 |
| 3,176,900 | A * | 4/1965 | Ciganenko | 229/125.19 |
| 3,285,492 | A * | 11/1966 | Demby et al. | 206/175 |
| 3,330,715 | A | 7/1967 | Terzuoli | |
| 3,342,322 | A | 9/1967 | Weisner et al. | |
| 3,345,921 | A | 10/1967 | Foss | |

(Continued)

FOREIGN PATENT DOCUMENTS

| | | |
|---|---|---|
| DE | 336485 | 5/1921 |
| DE | 4223978 | 1/1994 |

(Continued)

OTHER PUBLICATIONS

Official Action for Chinese Patent Application No. 200980131603.2, dated Apr. 11, 2013, 10 pages.

(Continued)

*Primary Examiner* — Gary Elkins

(74) *Attorney, Agent, or Firm* — Sheridan Ross P.C.

(57) ABSTRACT

The present disclosure is directed to a retail box and a method of making a retail box. Retail boxes in accordance with the present disclosure can be manufactured beginning with a moisture impermeable paper or substrate, which is rolled on a core. Two halves of the box, or "half-boxes," are first produced, and then brought together to form a complete box. The corners of the complete box can be sealed with a caulk or other sealing material to form a moisture impermeable container.

14 Claims, 12 Drawing Sheets

(56) References Cited

U.S. PATENT DOCUMENTS

| | | | | | |
|---|---|---|---|---|---|
| 3,370,777 | A | | 2/1968 | Levi | |
| 3,436,893 | A | | 4/1969 | Vokes et al. | |
| 3,486,612 | A | | 12/1969 | Kivell | |
| 3,543,994 | A | * | 12/1970 | Clark | 229/125.32 |
| 3,577,484 | A | * | 5/1971 | Jacobson | 264/571 |
| 3,622,063 | A | | 11/1971 | McVeigh | |
| 3,838,632 | A | | 10/1974 | Miyake | |
| 3,981,758 | A | | 9/1976 | Thayer et al. | |
| 4,418,861 | A | | 12/1983 | McFarland et al. | |
| 4,461,137 | A | | 7/1984 | Wood | |
| 4,650,448 | A | | 3/1987 | Urso | |
| 4,750,660 | A | | 6/1988 | Kamimura | |
| 4,802,421 | A | | 2/1989 | Atterby et al. | |
| 4,871,067 | A | | 10/1989 | Valenti | |
| 4,976,374 | A | | 12/1990 | Macaluso | |
| 5,201,461 | A | | 4/1993 | Skykora | |
| 5,333,779 | A | | 8/1994 | Skykora et al. | |
| 5,350,348 | A | | 9/1994 | Guot | |
| 5,476,219 | A | * | 12/1995 | Kim | 229/132 |
| 5,577,612 | A | * | 11/1996 | Chesson et al. | 206/494 |
| 6,029,884 | A | | 2/2000 | Roeland | |
| 6,499,655 | B1 | | 12/2002 | Moen | |
| 6,851,602 | B2 | | 2/2005 | Gosis et al. | |
| 7,069,856 | B2 | | 7/2006 | Hartka et al. | |
| 8,037,663 | B2 | * | 10/2011 | Jensen | 53/456 |
| 2008/0002011 | A1 | | 1/2008 | Mizutani et al. | |

FOREIGN PATENT DOCUMENTS

| | | | | | |
|---|---|---|---|---|---|
| DE | 10111232 | | | 9/2002 | |
| GB | 2155438 | A | * | 9/1985 | 229/122.21 |
| JP | 49-131226 | | | 11/1974 | |
| JP | 49-131231 | | | 11/1974 | |
| JP | 06-191528 | | | 7/1994 | |
| JP | 07-100962 | | | 4/1995 | |
| WO | WO 2005/075185 | | | 8/2005 | |

OTHER PUBLICATIONS

Official Action (including English translation) for Japanese Patent Application No. 2011-518804, mailed Jul. 2, 2013, 8 pages.
Official Action for Chinese Patent Application No. 200980131603.2, dated Sep. 5, 2012, 16 pages.
Notice of Allowance and Fee(s) Due for U.S. Appl. No. 12/463,883, mailed Jun. 15, 2011, 6 pages.
International Preliminary Report on Patentability for PCT Application No. PCT/US09/50196, mailed Apr. 21, 2011, 11 pages.
Official Action for U.S. Appl. No. 12/463,883, mailed Dec. 27, 2010, 12 pages.
Restriction Requirement for U.S. Appl. No. 12/463,883, mailed Oct. 28, 2010, 6 pages.
Restriction Requirement for U.S. Appl. No. 12/463,883, mailed Sep. 13, 2010, 5 pages.
International Search Report for PCT Application No. PCT/US09/50196, mailed Sep. 9, 2009, 4 pages.
Written Opinion for PCT Application No. PCT/US09/50196, mailed Sep. 9, 2009, 9 pages.
Official Action for Canada Patent Application No. 2,733,817, dated Nov. 1, 2013, 3 pages.
Official Action for Canada Patent Application No. 2,733,817, dated Jun. 4, 2014, 3 pages.
Notice of Allowance with English Translation for Japan Patent Application No. 2011-518804, mailed Dec. 2, 2014 2 pages.
Extended Search Report for European Patent Application No. 09798590.7, dated Mar. 18, 2013, 10 pages.
Official Action for European Patent Application No. 09798590.7, dated Jul. 21, 2015, 7 pages.

* cited by examiner

RETAIL BOXES AND METHOD OF MANUFACTURING RETAIL BOXES

CROSS REFERENCE TO RELATED APPLICATIONS

This application is a continuation-in-part of U.S. patent application Ser. No. 12/463,883 filed May 11, 2009, which claims the benefit of U.S. Provisional Patent Application Ser. No. 61/080,237 filed on Jul. 12, 2008, the entire disclosures of which are hereby incorporated herein by reference.

FIELD

The present disclosure is related to retail boxes and machinery and methods for making retail boxes.

BACKGROUND

Retail boxes are used widely by companies and individuals to package retail items for shipping to customers. Typically, the manufacture and assembly of a retail box is divided between two processes or machines that may be associated with different service providers or companies. Specifically, a retail box is first manufactured from raw materials, such as cardboard. This manufacturing process or step may occur using a dedicated machine that may be associated with a dedicated plant or company, which provides this service or manufacturing step. Secondly, the retail box is opened or assembled into a usable configuration. This step may be performed by a second dedicated machine, which may be located at a separate facility from the facility that had manufactured the retail box. This two-step process can lead to inefficiencies and added costs that may be born by companies or individuals who purchase a retail box.

Retail boxes are generally sold in an assembled condition. A purchaser of a retail box will typically purchase a particular quantity of retail boxes, which remain on hand for use in shipping. As can be appreciated, a company that ships a large volume of retail items may require a large inventory of retail boxes to be on hand to meet the needs of shipping various retail items. Maintaining a large inventory of retail boxes can have disadvantages, such as the need to pay taxes on the maintained inventory and space requirements associated with storing the quantity of retail boxes. Additionally, standard retail boxes are damaged easily when impacted by crumbling or tearing.

Containers for products that require protection from moisture generally include a moisture barrier component and a structured support component. For example, products such as cereal and printer cartridges are often packaged in a two part container that includes an inner, moisture impermeable bag, that is held within an outer cardboard box. As another example, cookies and crackers are often held in a plastic tray that is in turn placed in a moisture impermeable bag. Because these containers are formed from multiple parts, they are relatively expensive. In addition, they often incorporate non-renewable materials and can be difficult or impossible to recycle.

Accordingly, it would be desirable to have a system and method for manufacturing retail boxes that combine the manufacture and opening and/or assembly of the boxes together in one process. Additionally, it would be desirable to have a system and method of making retail boxes that allows retail boxes to be manufactured at the point of use; therefore, reducing the quantity of retail boxes that need to be maintained as inventory or substantially eliminating the need to maintain an inventory of boxes, thereby making available resources to more productive activities. Additionally, it would be desirable to have a system and method for manufacturing retail boxes that produces boxes that are more resilient to impact, having glued flaps that are able to bend or recoil and fully recover from impacts. Additionally, it would be desirable to have a system and method for manufacturing retail boxes where the box is made from substrate that is inline printable, allowing custom printing to be performed during manufacture of the box, leading to faster time to market. Additionally, it would be desirable to have a system and method for manufacturing retail boxes where the box is made from a substrate that is substantially thinner than materials used to make current retail boxes, which is a desirable economic and ecological feature. It would also be desirable to have a system and a method for providing boxes that incorporates a moisture impermeable barrier, without requiring multiple components, and/or without being formed from non-renewable materials.

SUMMARY

The present disclosure is directed to a system and method for manufacturing retail boxes. The disclosed invention is operable to produce a retail box from paper, which is rolled on a core or provided in sheet form. The paper can include a moisture impermeable barrier or layer. Initially, a top and a bottom of the box are produced. The two halves of the box are interconnected. In accordance with at least some embodiments, gaps between the two halves of the box and in particular at the corners of the box can be sealed with a sealant, to provide a container or volume that is entirely or substantially impermeable to moisture. For each of the top and bottom half of the box, a portion of paper that is output from paper rolled on a core or a sheet or a section of a sheet is applied.

In one embodiment, each of the top and the bottom halves are received in a folding plow, which folds the box portions into two complementary half-boxes. The two half-boxes are then brought together and glued at their respective sides. The overlapping box side portions are fully coated with glue when assembled, creating a strong composite structure. In one embodiment, tension is maintained on the assembled box structure and paper webbing in the direction of the webbing throughout the process and at least until the glue substantially cures. The assembled portion is now cut to length and at least one end portion of the box remains open allowing merchandise or other items to be placed in the interior of the box. Upon cutting to length, and before placing merchandise in the box, tension is applied to the assembled box in a direction substantially perpendicular to the direction of the previous tension and at a substantially right angle to the glued box side surface when the box is in an opened configuration. One of the ends may be optionally closed at this point by fully coating at least one surface of the end flaps and assembling the end flaps together. Merchandise or other items may then be placed in the box, and the remaining open box end may then be closed in a similar manner as the other end.

In another embodiment, the paper may be received in a rotary die cutting module. Here, the paper is cut into a desired shape and optionally scored and/or creased. The rotary die cutting module may cut portions of the paper webbing that will ultimately form the dust flaps, end flaps or sides of the box. After the top and bottom halves of the box have been cut and creased, the paper may then be fed into a folding plow.

In yet another embodiment, the paper webbing may be received by an inline printer. The inline printer may be used to print directly on the substrate at any point in the process.

In accordance with further embodiments of the present invention, any gaps remaining after formation of the box can be sealed. For example, gaps that may occur at the corners of a completed box can be sealed using a caulk or other gap filling substance. In accordance with still other embodiments, the glue used to adhere different portions of the box to one another in the vicinity of gaps can be provided in amounts in excess of what is required to join those portions, such that the gaps will be sealed by the glue. In accordance with still further embodiments, gaps can be covered by tape, or by adhering patch pieces over the gaps. In accordance with embodiments of the present invention, the caulk or other material used to seal gaps in a completed box can itself be moisture impermeable, and may form a moisture impermeable seal with the material of the box itself. When combined with a box material that is itself moisture impermeable, a moisture impermeable or sealed container defining a sealed volume that is moisture impermeable is created.

In accordance with embodiments of the present invention, a box formed from two cooperating half-boxes is provided. Each half-box may be formed from rolled or sheet paper or other substrate material. In accordance with further embodiments of the present invention, the paper or substrate material may be impermeable to moisture. Accordingly, the substrate or paper may comprise a coated paper, a paper or substrate incorporating a moisture impermeable film or membrane, or may be formed from moisture impermeable material. Overlapping side and end portions of the two box halves can be entirely or substantially coated with an adhesive or other bonding agent. The adhesive or bonding agent can be waterproof. In addition, dust flaps can be adhered to other dust flaps, side flaps and/or end flaps. In accordance with further embodiments of the present invention, an assembled box can include sealant on at least the corners of the box. Such sealant can, for example, silicon, epoxy, or other caulk or adhesive. The sealant at the corners of the assembled box cooperates with the moisture impermeable paper or substrate material, to form a completed box that is entirely or substantially moisture impermeable.

These and other features of embodiments of the disclosure can be further understood from the following description, particularly when considered in connection with the accompanying drawings.

DETAILED DESCRIPTION

The present disclosure is directed to a retail box and a method of making a retail box. Retail boxes in accordance with the present disclosure are manufactured beginning with paper, which is rolled on a core, or alternatively is provided in sheet form. As used herein, a "retail box" refers to any box suitable for containing an item, for otherwise creating a desired volume, for creating a display, or for creating any other box-like structure. Two halves of the box, or "half-boxes," are first produced, and then brought together to form a complete box. In manufacturing a retail box from rolled or sheet paper, the present disclosure allows a retail box to be manufactured and assembled at the point of use. Specifically, a shipper or retailer who requires packaging for a particular item may keep rolled paper or sheets of paper on hand, and use the paper to manufacture a box when needed.

Figure 1:
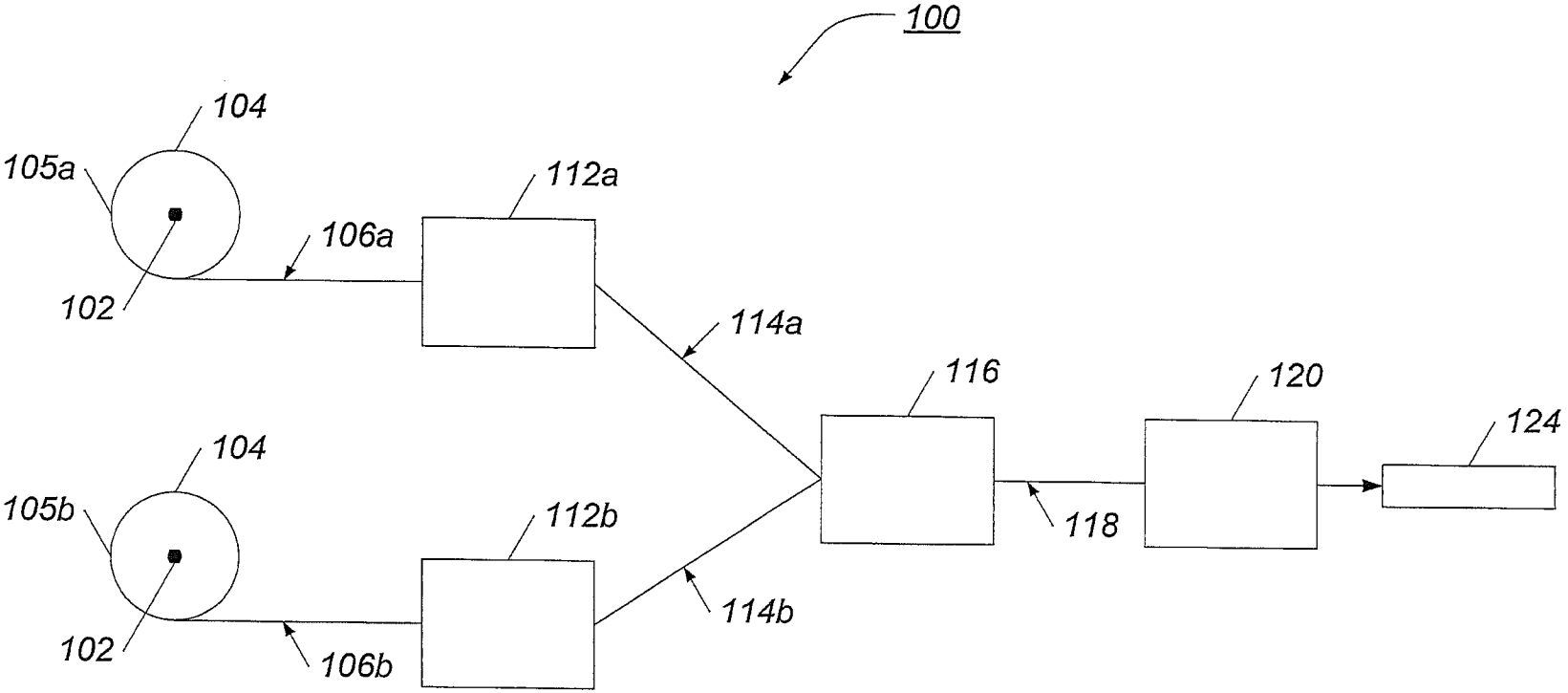
FIG. 1 is a diagram showing the manufacture and assembly of a retail box, in accordance with embodiments of the present disclosure.

With reference to FIG. 1, a system 100 for manufacturing a retail box in accordance with embodiments of the present disclosure is depicted. In manufacturing a retail box, the present disclosure begins with one or more supplies 104 of paper or other substrate 105 material that are each rolled onto a respective core 102. For the purposes of illustration, FIG. 1 includes two paper rolls 105*a* and 105*b* to supply paper for the two half-boxes that will be used to form a completed box. As can be appreciated by one of skill in the art after consideration of the present disclosure, as an alternative, one paper roll 105, which supplies paper or paper webbing 106 for both half-boxes may be used. As an alternative to one or multiple rolls of paper 105, the paper supplies 104 may be in the form of individual sheets of paper. As a first step in manufacturing a retail box in accordance with embodiments of the present invention, paper 106 is dispensed from a paper supply 104 and received in a folding plow 112. The folding plow 112 receives the paper webbing 106 and creases and folds the paper 106, to form a half-box blank 114. The half-box blank 114 is then sent to bonding or gluing station 116 where it is joined with another half-box blank 114 to form an assembled box blank 118. The assembled box blank 118 then passes to cutting station 120, where the box blank is cut to length, producing a box 124. As shown in FIG. 1, two folding plows 112*a* and 112*b* may be provided to form half-box blanks 114*a* and 114*b* from two supplies 104 of paper 106*a* and 106*b*.

In another embodiment of the present disclosure, a rotary die cutting module may accept the paper webbing 106 before passing the webbing to the folding plow 112. The rotary die cutting module receives the paper and cuts and creases the paper to produce creases in the webbing to better enable the folding plow 112 to create creased and folded paper 114 comprising or that will comprise a half-box blank. Additionally as one having skill in the art will appreciate, the rotary die cutting module is operable to produce creases and/or cuts in the paper webbing 106 in locations that may ultimately form the dust flaps, end flaps or sides of the box. As one having skill in the art will appreciate, removal of a certain amount of material, for example, on the dust flaps resulting in a tapered flap (e.g., trapezoidal), may ease later assembly of the end flaps and dust flaps.

Figure 2A:
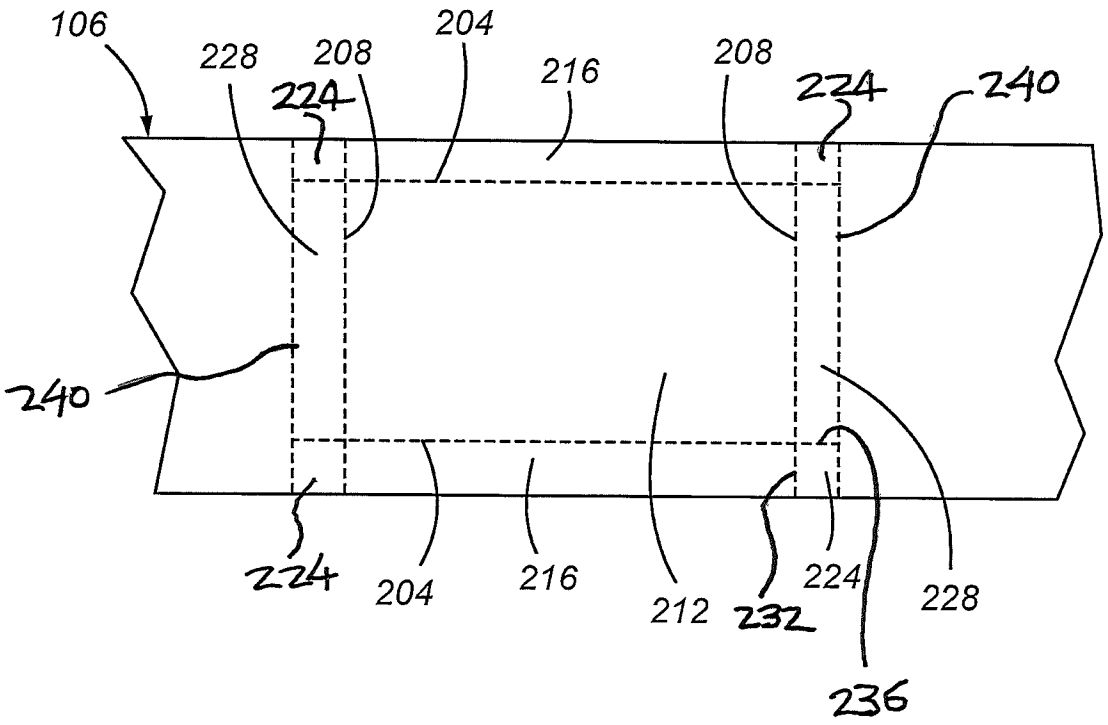
FIG. 2A shows a segment of paper webbing and score lines along which folds and/or cuts may be made.

FIG. 2A shows a segment of the paper webbing 106 and illustrates the portions of the webbing that will ultimately become features of a box. More particularly, the portions of the webbing 106 between end lines 240 will become a half-box blank. Score lines 204 and 208 represent lines along which the webbing will be folded to create a central section 212, the side flaps 216, the end flaps 228 and the dust flaps 224. As is shown, the section of webbing will become a half-box having a central section 212 and four flaps, including two side flaps 216 and two end flaps 228 that depend from the central section 212. One having skill in the art will appreciate that a dust flap 224 may be cut and configured to depend from either the side flaps 216 or the end flaps 228. For example, if the segment 232 extending from one side of the paper webbing 106 to an adjacent score line 204 comprises a cut line, the dust flap 224 adjacent that cut line 232 will depend from the adjacent end flap 228. Alternatively, if a cut is formed along segment 236, extending between the end line 240 and the adjacent score line 208, the dust flap 224 will depend from the side flap 216. In one embodiment, score lines 204 and 208 may represent creases or score lines created by a rotary die module along which the folds will be created.

Figure 2B:
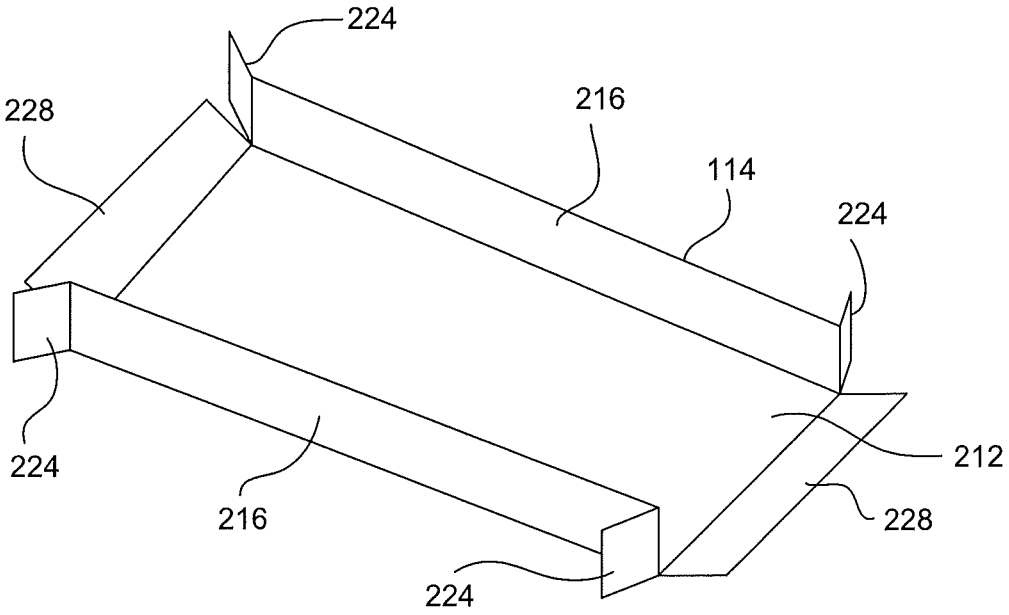
FIG. 2B shows a half-box blank in accordance with embodiments of the present invention.
Figure 2C:
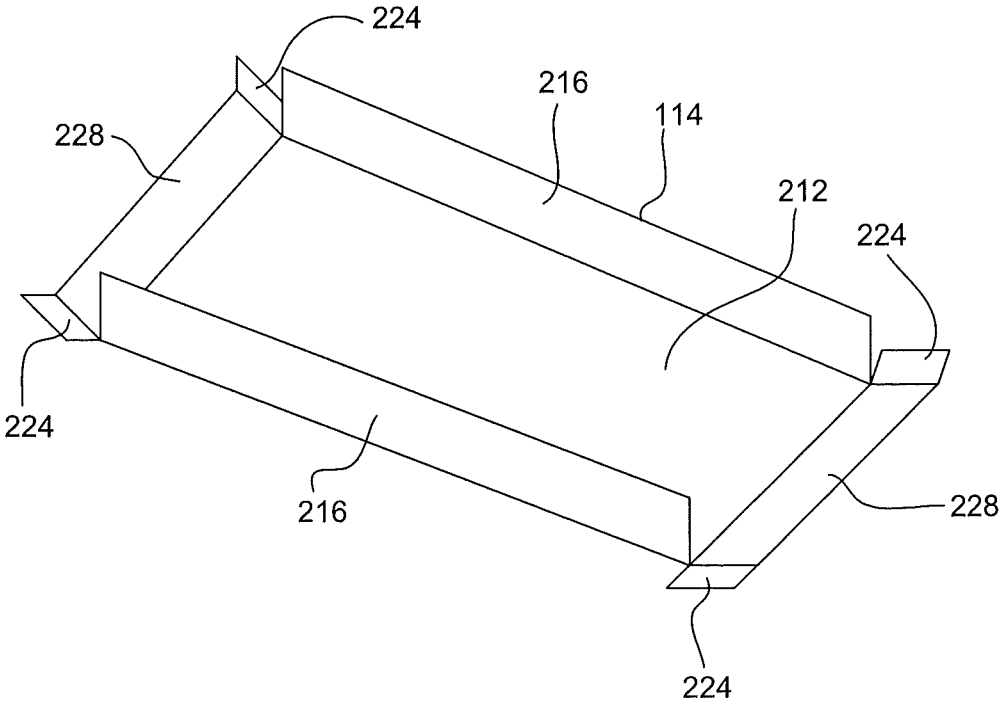
FIG. 2C illustrates a half-box blank in accordance with still other embodiments of the present invention.

FIG. 2B illustrates a half-box blank 114 having dust flaps 224 that depend from side flaps 216. FIG. 2C illustrates a half-box blank 114 with dust flaps 224 that depend from end flaps 228.

Figure 3A:
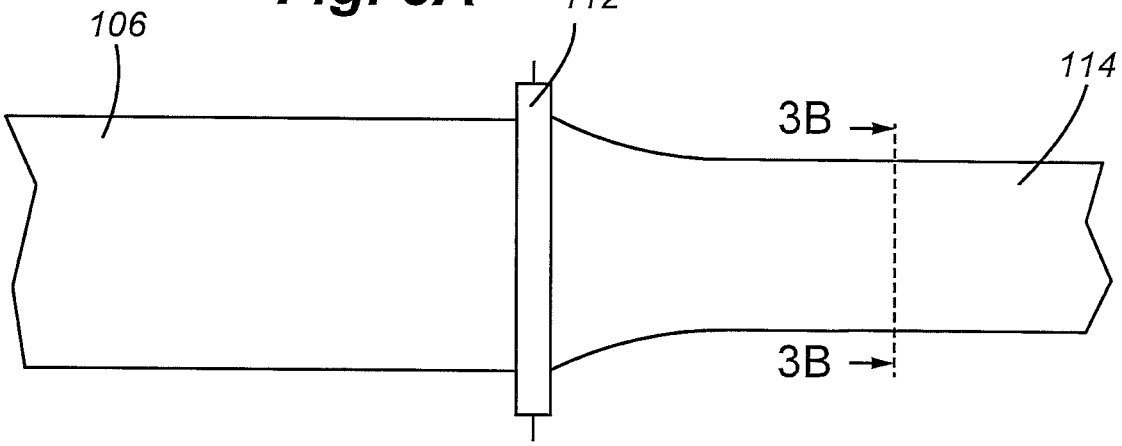
FIG. 3A shows paper webbing as it passes through a folding plow.
Figure 3B:
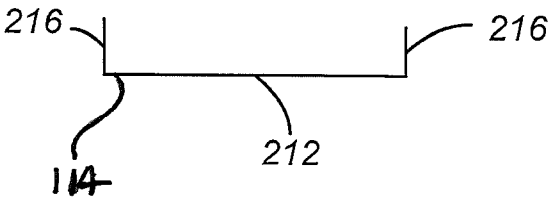
FIG. 3B shows a cross-sectional view of the paper webbing after it has passed through the paper plow.

FIG. 3A shows the paper webbing 106, before and after it passes through the folding plow 112, at which point it comprises a half-box blank 114. FIG. 3B is a cross-sectional view of the half-box blank 114 after it has passed through the folding plow 112. As shown, the half-box blank 114 generally has a U-shape, and having a central section 212 and two side flaps 216 depending from either side of central section 212. Prior to joining the two half-boxes, the side flaps 216 of each half-box blank 114 can be folded by the folding plow 112 so that the side flap 216 is approximately 90 degrees with respect to the central section 212, as shown in FIG. 3B.

With reference again to FIG. 1, after two half-box blanks 114 are produced, whether in series or in parallel, the two half-box blanks 114 are brought together at the gluing station 116. In accordance with embodiments of the present disclosure, the gluing station 116 includes a glue gun operable to dispense glue or some other bonding agent. In the gluing station 116, glue is dispensed to coat at least a portion of one side of a side flap 216, associated with one of the half-box blanks 114. This coated side flap 216 is then brought together or joined with a corresponding side flap 216 on the other half-box blank 114. Before bringing together the two corresponding side flaps 216 of the two half-boxes, glue or some other bonding agent may also be applied to the other side flap 216, so that both side flaps 216 have glue on at least one side of the flap, preferably the side that faces or comes into contact with the side flap 216 of the opposite half-box blank 114. The bonding agent (e.g., glue, epoxy, resin, cement or adhesive) may be applied to the side flap 216 in an engineered pattern coating, which is designed to provide support and bear load for the side flaps 216. The bonding agent is preferably spread over close to all, or substantially 100% of the side flap 216. A device other than, or in addition to, the glue gun may be used to achieve substantially 100% coverage including, for example, a sprayer, a roller, a nozzle, static, a glue roller and a flat edge (e.g., for evenly spreading the glue). The glue is preferably spread over a majority of one or both of the side flaps 216, and is more preferably close to or substantially 100% coverage. One having skill in the art will appreciate that the engineered pattern coating may be a grid-like coating or matrix pattern of bonding agent that is applied to one or both of the side flaps 216. One having skill in the art will also appreciate that a combination of a grid-like coating or matrix pattern and a smooth layer may be used to achieve the necessary strength in the bonding agent layer. The glue is preferably at a low viscosity during application to either or both side flaps 216. The glue is preferably elastic when dry, and is preferably a hot-melt glue with a relatively fast curing time. The hot melt glue preferably cures as its temperature drops. One having skill in the art will appreciate a preferable cure time based on the operational requirements of the box assembly system. One having skill in the art will also appreciate the methods used to accelerate curing of the glue including, for example, cooling the machinery at a point after the bonding agent is applied using liquid coolant (e.g., water), using compressed air, using solid-state coolers, or applying ultraviolet (UV) radiation.

In bringing together two half-box blanks 114, the corresponding side flaps 216 are glued together. This produces a box having four closed sides and two open sides, the open sides including end flaps 228 and dust flaps 224 of each half-box. Moreover, the two side flaps 216 forming opposite sides of the box 124 are composite box side portions, each comprising one side flap 216 of one of the half-box blanks 114, bonded to one side flap 216 of the other one of the half-box blanks 114.

In accordance with embodiments of the present invention, an amount of glue in excess of an amount required to join corresponding side flaps 216 of two half-box blanks 114 to one another is applied. In particular, excess glue can be applied at edges of the side flaps 216 near or adjacent the score lines 208 that generally define the ends of the side flaps. In accordance with still further embodiments, the excess glue may be in the form of a caulk or filling agent having adhesive properties. Moreover, the glue or caulk can be pliable, to form a seal with an adjacent end flap 228 and/or dust flap 224, to seal the corners of the assembled box 124 when the ends of the box 124 are closed.

It is one aspect of the present disclosure that the paper or other substrate 106, 114 is held in tension in the longitudinal direction through the processes of gluing the side flaps 216. The paper or other substrate 106, 114 is preferably held in tension until the glue substantially cures. Tension may be maintained in the paper or substrate 106, 114 in the longitudinal direction using conventional methods including, for example, web handling equipment from the moment the paper or substrate 106 comes off the rolls 104 through the folding plows 112 and the gluing station 116. After the glue has cured or substantially cured, the tension in the longitudinal direction may be released.

It is another aspect of the present disclosure that the assembled paper or substrate may be cut to length in cutting station 120. One having skill in the art will appreciate the methods by which the paper or other substrate 106 may be cut, including, for example a blade, press, knife, rotary saw, band saw, reciprocating blade, laser and water jet.

Figure 4:
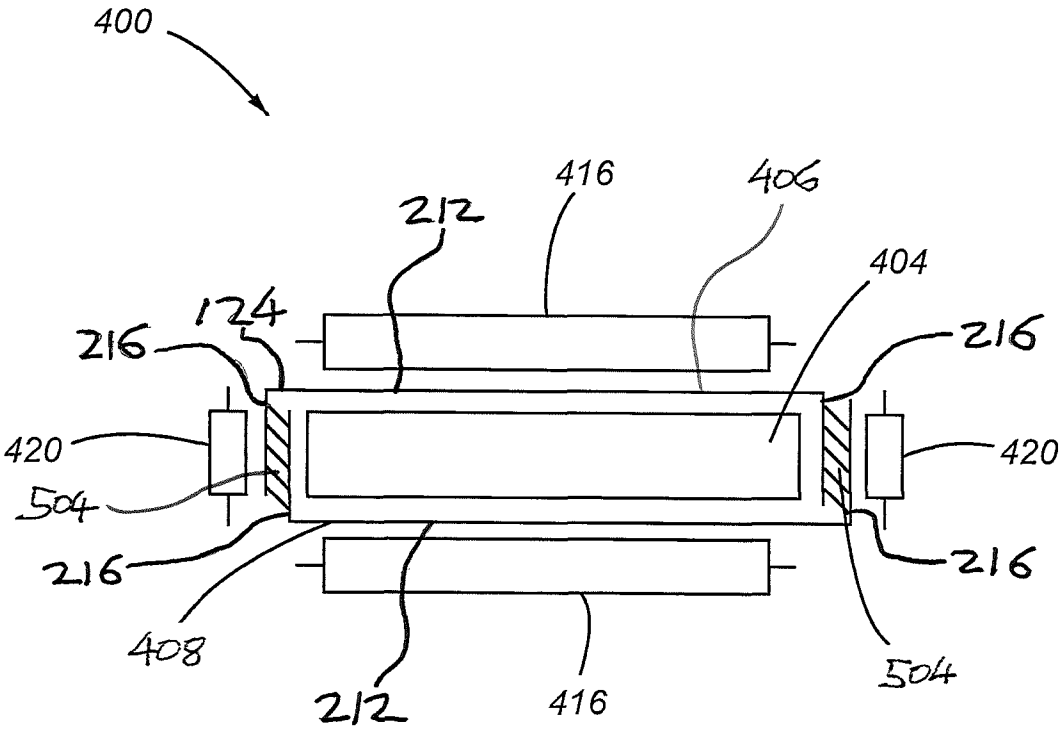
FIG. 4 shows an assembled box being engaged by rollers and a box guide.

FIG. 4 shows a cross-sectional view 400 of a top half 406 and a bottom half 408 of the box 124 assembled with glue or some other bonding agent 504. As can be seen in FIG. 4, the top half 406 of the box shows the side flaps 216 depending downward from the top half 406 central section 212. The bottom half 408 of the box shows the side flaps 216 depending upward from the central section 212. More particularly, each side flap 216 of the top half 406 portion of the box 124 is interconnected to an adjacent or corresponding side flap 216 of the bottom half 408 portion of the box 124 by a bonding agent 412.

FIG. 4 shows an embodiment in which a box structure 404 is disposed inside of the assembled (but not completely closed) box. The box structure 404 is a guide upon which the half-box blanks 114 sit or are assembled around in the gluing station 116. The box structure 404 serves as a support that provides an opposing force to the top and bottom rollers 416 and side rollers 420. The box 124 is not glued to or otherwise permanently attached to the box structure 404, but the box structure 404 may be a stationary structure upon which the assembled box 124 slides as it is pulled by the rollers 416, 420. The force exerted on the assembled box 124 by the rollers 416, 420 provides tension to the webbing of the box 124 in the longitudinal direction during the gluing process. The side rollers 420 further serve to press the adjacent side flaps 216 together, causing the glue to spread evenly between the side flaps 216 and eliminate any voids that may be present. The figure shows the assembled box 124 having single-ply top and bottom sides and double-ply, composite or laminated side flaps 412. The attaching or gluing occurs on two side flaps 216 of the half-boxes, while the remaining two end flaps 228 and dust flaps 224 of the half-boxes are left unglued. Accordingly, an assembled box 124 is produced with an open front end and an open back end.

The side rollers 420 are shown with their axes substantially perpendicular to the longitudinal direction. In another embodiment of the present disclosure, the rollers may be rotated up to 90 degrees or oriented so that their axes are in a range between substantially perpendicular and substantially parallel to the longitudinal direction. The rotation or orientation of the side rollers 420 other than substantially perpendicular combined with the frictional force between the roller and substrate creates a tension in the side flap 216 in a direction other than longitudinal and in a direction that is oblique to the tension in the adjacent side flap 216.

Figure 5:
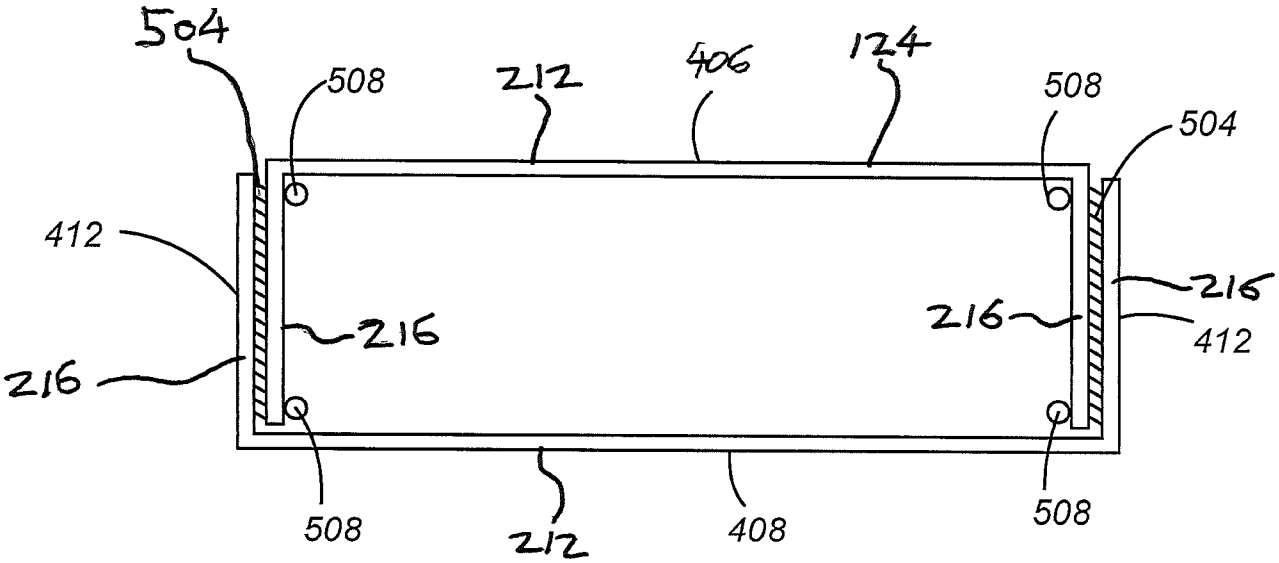
FIG. 5 shows a cross-sectional view of an assembled box being engaged by tensioning prongs.

FIG. 5 shows a cross-sectional view of an assembled box 124. The figure illustrates the composite side flaps 412 of the box having overlapping side flaps 216, and having substantially 100% coverage (e.g., 100% coverage ±10%) of bonding agent 504 between the respective side flaps 216, to form the composite or laminated, double-ply or two-ply side flaps 412 of the box 124. The figure also illustrates that in the final box 124 configuration, the composite, double-ply side flap 412 has a thickness that is more than twice that of the thickness of a single side flap 216. The figure shows the box 124 having prongs or pins 508 located at the corners of the box 124. Before, during or after the assembled paper or substrate is cut to length in process 120, these prongs 508 are inserted into the hollow cavity on the inside of the box 124, and force is applied by the prongs 508 to provide tension around a periphery of the assembled box 124. For example, the applied force may be in a direction that is perpendicular to the creases defining the side flaps 216. One having skill in the art will appreciate the prongs 508 could be configured as four pins, two thin bars or a combination thereof that can slide in and out of the box corners without damaging the box.

Figure 6:
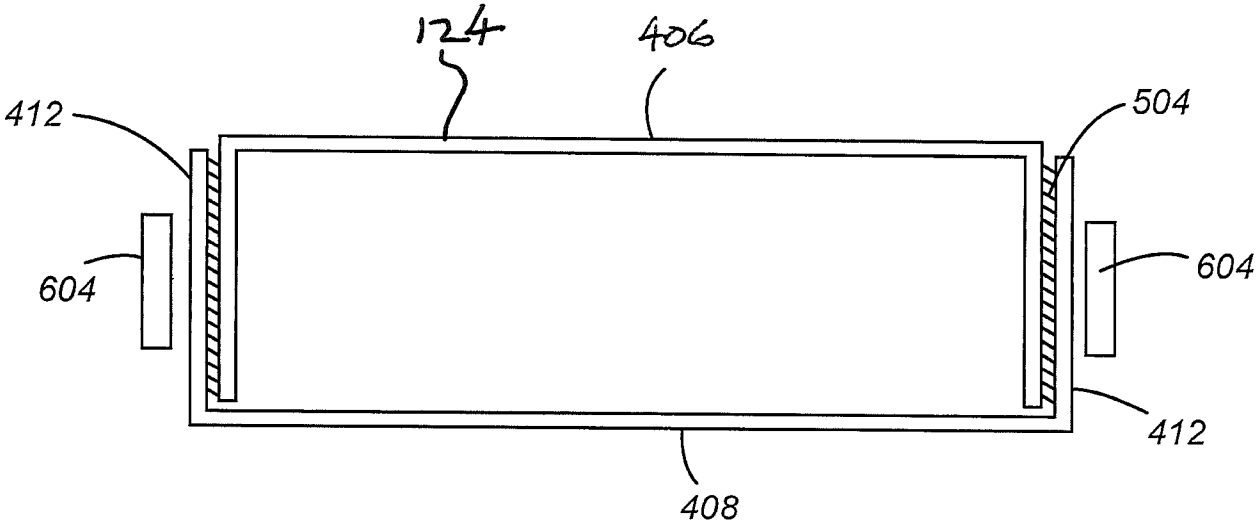
FIG. 6 shows a cross-sectional view of an assembled box being engaged by vacuum plates.

In an alternative embodiment, vacuum plates can be used to grasp (using a vacuum) the composite side flaps 412 of the box to provide perpendicular tension. FIG. 6 is a cross-sectional view of an assembled box 124 and illustrates how vacuum plates 604 can be positioned adjacent to the composite side flaps 412 of the box 124 to provide the desired tension to the box 124.

Figure 7A:
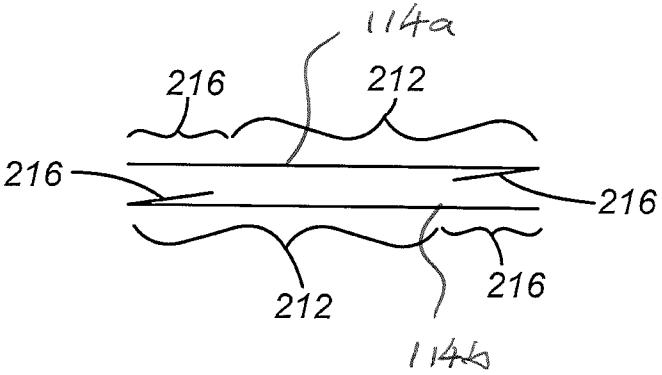
FIGS. 7A & B show a cross-sectional view of the assembly of two half-boxes in an alternate embodiment.

FIG. 7A, shows a cross-sectional view of two half-box blanks 114 of a box in accordance with embodiments of the present invention. Each half, a first or upper half 114*a* and a second or lower half 114*b*, has a central section 212 and two side flaps 216 that comprise the longitudinal sides of the box. In this embodiment of the present disclosure, only one of the side flaps 216 of a half-box blank 114 is folded over. As shown in the figure, one of the side flaps 216 of the top half-box blank 114 is folded over and one of the side flaps 216 of the bottom half-box blank 114 is folded over. The side flap 216 that is folded over is selected so that when the two halves are assembled, the folded over side flaps 216 are opposite each other. As described above, the upper and lower half-box blanks 114 are assembled in the gluing station 116, where glue or another bonding agent is applied as an engineered pattern coating on the surface of one or both opposing surfaces of the side flaps 216. As also described above, the two half-box blanks 114 are then brought together, and force is applied to bind the two halves together at the portions where glue has been applied. One having skill in the art will appreciate the methods that may be used to apply said force including, for example, a press, a roller disposed on either side of the flat box (either above or below), or more preferably two rollers disposed on both sides of the flat box (both above and below).

Figure 7B:
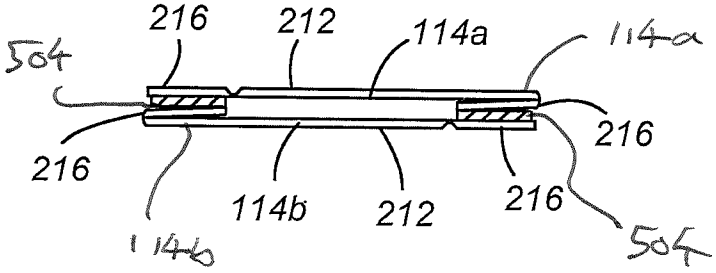

The result when the two half-box blanks 114 are assembled, as shown in FIG. 7B is a flat box assembly where at least one side flap 216 of a half-box blank 114 is substantially coplanar with the central section 212. In particular, the bonding agent 504 joins corresponding side flaps 216 of the two half-box blanks 114 to one another. As one having skill in the art will appreciate, the configuration illustrated in FIGS. 7A & B may be preferable for applications where the box does not immediately receive an item, and the assembled box is intended to be stored in a flat configuration for later expansion and use.

Figure 8A:
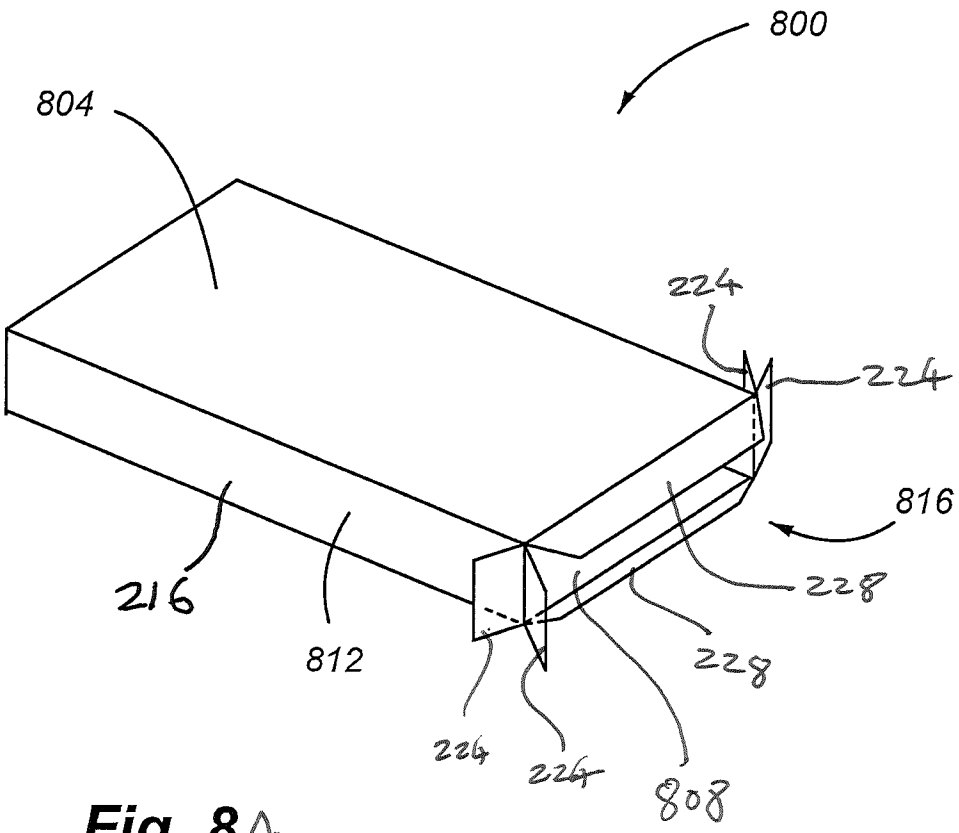
FIG. 8A is an illustration of an assembled box.

In FIG. 8A, an assembled box 800, in accordance with embodiments of the present disclosure is shown. The assembled box 800 includes a top side 804 and a bottom side 808. As can be appreciated from the discussion above, the top side 804 and the bottom side 808 are single ply sides. The remaining four sides of the box 800 are double ply sides. It will be understood that the ends 816 will be double-ply upon closure. In particular, the box 800 includes two double-ply sides 812, one of which is visible in FIG. 8A. Additionally, the box 800 includes two ends 816, one of which is visible in FIG. 8A. The sides 812 are closed by the gluing process described above. In accordance with embodiments of the present disclosure, the ends 816 remain open and operable to receive items therethrough into the interior of the box 800. After items are received by or inserted into the box 800 through either of the two ends 816, one or both of the ends 816 of the box 800 may be closed and box may then be shipped, stored, etc., as needed. In another embodiment of the present disclosure, one of the ends 816 is closed before or substantially at the same time the box 800 receives items or payload. Thereafter, the remaining end 816 may be closed, and the box 800 and item assembly is then ready to be shipped, stored, etc., as needed. An end flap 228 of a half-box may be closed or assembled to a corresponding end flap 228 of a corresponding half-box using a glue gun operable to dispense glue. Once glue is applied to one or both facing sides of end flaps 228 (i.e., sides that are facing upon assembly), the flaps are brought together to bond them. The glue is preferably spread over close to all, or substantially 100% of the end flap 228. A device other than, or in addition to, the glue gun may be used to achieve substantially 100% coverage including, for example, a sprayer, a roller, a glue roller and a flat edge (e.g., for evenly spreading the glue).

In one embodiment of the present disclosure, the dust flaps 224 at a corner may both depend from the end flaps 228. In another embodiment, one dust flap 224 may depend from one of the end flaps 228, and the other dust flap 224 may depend from one of the side flaps 216. In yet another embodiment, the dust flaps 224 at a corner may both depend from the side flaps 216.

Figure 8B:
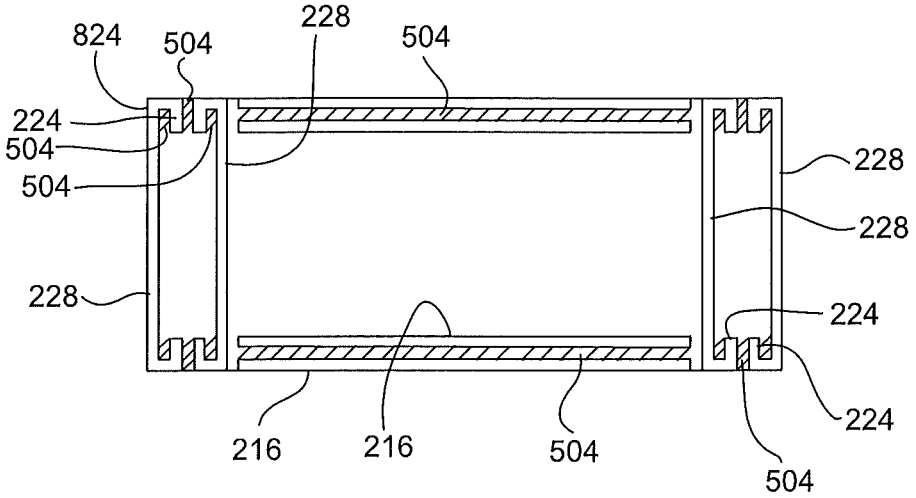
FIGS. 8B-8D are cross-sections of assembled boxes in accordance with embodiments of the present invention.

It is another aspect of the present disclosure that both dust flaps 224 at a corner of the box may be glued to one or both end flaps 228 at that corner. Specifically, glue or another bonding agent 504 may be applied to the dust flaps 224 with a glue gun or some other means, and the dust flaps 224 are then brought together with an end flap 228 and/or each other. Having the dust flaps 224 glued to one side of each corner provides substantial strength to the box, and improves the strength at the corners as the corners absorb impacts and bear much of the load of the box. One having skill in the art will appreciate that this aspect of the present disclosure creates a laminated four-ply portion 824 where the dust flaps 224 are glued to the end flaps 228. The portions of an end flap 228 not bonded to a dust flap 224 can be bonded to an adjacent end flap 228. This configuration is depicted in FIG. 8B, which depicts an assembled box 800 in a closed state in a cross-section taken along a plane parallel to and between the top 804 and bottom 808 sides of the box 800 (see FIG. 8A). In the embodiment illustrated in FIG. 8B, the dust flaps 224 all depend from the end flaps 228. As an alternative, the dust flaps 228 can all depend from the side flaps 216. In accordance with still other embodiments, some dust flaps 224 can depend from side flaps 216, and other dust flaps can depend from end flaps 228, in various combinations. In addition, the two-ply sides 812, formed from the lamination of adjacent side flaps 216 to one another with a bonding agent 504, are shown.

Figure 8C:
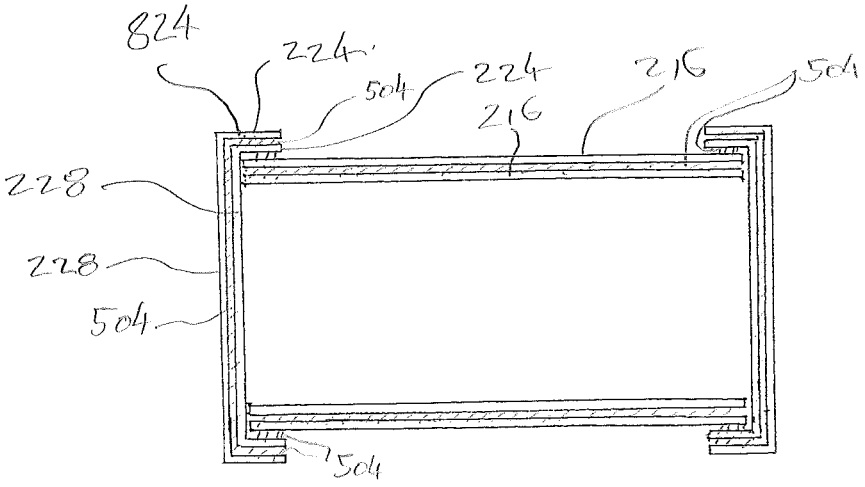

It is another aspect of the present disclosure that both dust flaps 224 at a corner of the box may be glued to an adjacent side flap 216, either directly or through the other dust flap 224 at the corner. Glue or another bonding agent 504 may be applied to the dust flaps 224 with a glue gun or some other means, and the dust flaps 224 are then brought together with a side flap 216 and/or each other. One having skill in the art will appreciate that this aspect of the present disclosure creates a laminated four-ply portion 824 where the dust flaps 224 are glued to the side flap 216. This configuration is illustrated in FIG. 8C, which depicts an assembled box 800 in a closed state in a cross-section taken along a plane parallel to and between the top 804 and bottom 808 sides of the box 800 (see FIG. 8A). In the embodiment illustrated in FIG. 8C, the dust flaps 224 all depend from the end flaps 228. As an alternative, the dust flaps 224 can all depend from side flaps 216. In accordance with still other embodiments, some dust flaps 224 can depend from side flaps 216, and other dust flaps can depend from end flaps 228, in various combinations.

Figure 8D:
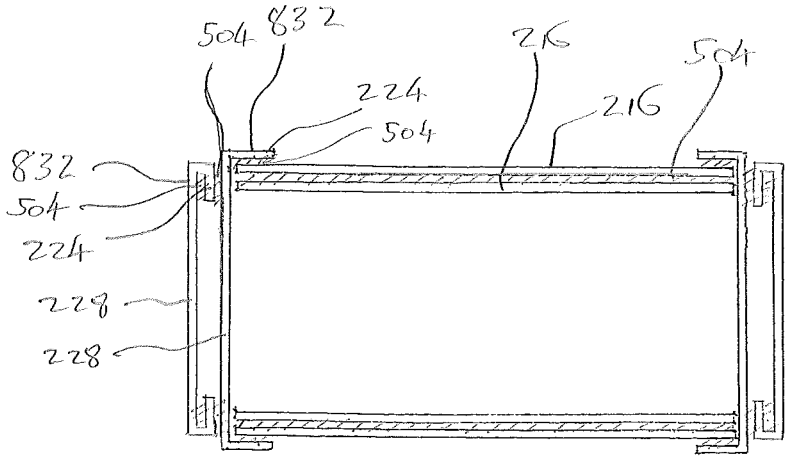

It is yet another aspect of the present disclosure that one dust flap 224 at a corner can be glued to an end flap 228, while a second dust flap 224 at the same corner can be glued to a side flap 216. Glue 504 may be applied to the dust flaps 224 with a glue gun or some other means, and one dust flap 224 is then brought together with an end flap 228, while the other dust flap 224 is then brought together with a side flap 216 to effect attachment of the dust flaps 224. One having skill in the art will appreciate that this aspect of the present disclosure creates two adjacent laminated three-ply portions 832 at each corner of the box 800. One three-ply portion 832 is on or adjacent the side flap 216 where one dust flap 224 is glued to the side flap 216, and the other three-ply portion 832 is on or adjacent the end flap 228 where second dust flap 224 is glued to the end flap 228. This configuration is illustrated in FIG. 8D, which depicts an assembled box 800 in a closed state in a cross-section taken along a plane parallel to and between the top 804 and bottom 808 sides of the box 800 (see FIG. 8A). In the embodiment illustrated in FIG. 8D, one dust flap 224 at each corner depends from an end flap 228, while the other dust flap 224 at each corner depends from a side flap 216. In accordance with other embodiments, other combinations are possible. For example, all of the dust flaps 224 at a corner can depend from end flaps 228 or side flaps 216.

It is still yet another aspect of the present disclosure that only one dust flap 224 at a corner is glued to either an end flap 228 or a side flap 216. Glue 504 may be applied to the dust flap 224 with a glue gun or some other means, and the dust flap 224 is then brought together with one of an end flap 228 or a side flap 216 to effect assembly of the dust flap 224. One having skill in the art will appreciate that this aspect of the present disclosure creates one three-ply portion. The three-ply portion is on the side flap 216 or the end flap 228 where the dust flap 224 is glued to the corresponding side or end flap.

In the foregoing descriptions of dust flap 224 assembly, the glue applied to the dust flap 224 is preferably spread over close to all, or substantially 100% of the surface of the dust flap 224 that is to be bonded to the other dust flap 224, end flap 228 or side flap 216, and a device other than, or in addition to, the glue gun may be used to achieve substantially 100% coverage including, for example, a sprayer, a roller, a glue roller and a flat edge (e.g., for evenly spreading the glue).

Figure 9:
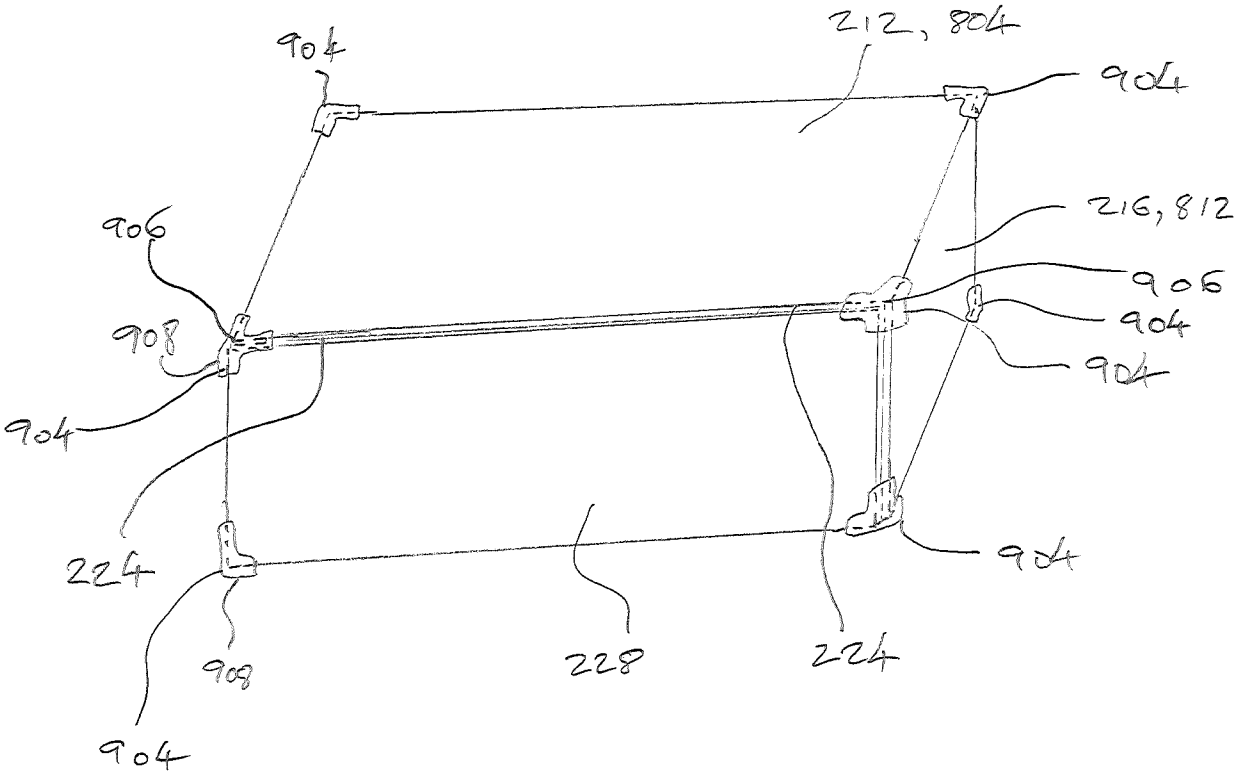
FIG. 9 is a partial prospective view of an assembled box in accordance with embodiments of the present invention.

In various applications, it can be desirable to provide a box or container that is impervious to moisture. For such applications, embodiments of the present invention can include half-box blanks 114 comprising a top half 406 and a bottom half 408 that are formed from paper or other substrate 105 material that comprises or incorporates a moisture barrier. In accordance with further embodiments of the present invention, the substrate 105 can feature both structural and moisture blocking attributes. In order to provide a sealed enclosure, half-box blanks 114 formed from a moisture impermeable substrate 105 material can be combined with measures taken during the assembly of the box 124 to provide a complete seal against moisture. For example, as previously described herein, glue or adhesive 504 in excess of an amount needed to cover or substantially cover the surface of a side flap 216 can be applied, such that the excess amount covers any gaps that might occur at the corners of the assembled box 124. In accordance with still other embodiments, as illustrated in FIG. 9, a caulk or other sealant 904 can be applied at the corners 906 of the box 124 after an end of the box 124 adjacent the corners is closed. In accordance with still other embodiments, a sealant 904 can comprise a sealing member 908, in combination with a sealant or adhesive, can be applied to the corners 906 of the box 124. The sealing member 908 can, for example, comprise a corner member having three orthogonal surfaces on at least an interior section, that can be adhered to the box 124 to seal the box at the corner to which the sealing member is applied, and alternatively or in addition, to provide additional structural support to the box 124. In accordance with further embodiments, a sealant 904 applied to the corners 906 of the box 124 can comprise one or more pieces of moisture impermeable sheet material adhered to the corners 906 of the box 124. For example, the sealant 904 can be in the form of a waterproof tape.

In accordance with embodiments of the present disclosure, any suitable type paper may be used to manufacture a box in accordance with the disclosure. For example, size 7-8 Manila paper may be used. Additionally, paper that is less than 40 mils thick may be used to produce a box in accordance with embodiments of the present disclosure. The paper is preferably of a porous construction as this is more effective for bonding. Moreover, embodiments of the present disclosure do not require paper taken from paper rolls. In particular, sheets of pre-cut paper may be used to form each half-box.

In accordance with other embodiments of the present disclosure, the paper could be replaced by a film including, for example, PE, PET, PVC, PEEK or other polymer based films.

It will be appreciated that when a non-fibrous or paper substrate is used, other chemical means may be used to bond the various sides, flaps, portions to other sides, flaps and portions. Additionally, techniques including, for example, ultrasonic welding may be used to bond the various sides, flaps, portions to other sides, flaps and portions.

In accordance with further embodiments of the present invention, a paper incorporating a moisture impermeable layer or layers can be used to manufacture a box in accordance with the present disclosure. For example, a poly coated (e.g., polypropylene coated) paper may comprise the substrate 105 used to form the half-box blanks 114 of a moisture impermeable box 124. As a further example, the substrate 105 can comprise an impermeable material that also provides stiffness. For example, the substrate 105 can comprise plastic or mylar.

A caulk or sealant 904 applied to the corners of an assembled and closed box 124 can comprise a silicon or other material capable of bonding to adjacent sections of the box halves 114, and of providing a barrier to moisture. Alternatively or in addition, a glue or filler applied, for example to the sides 216, ends 228 and/or dust flaps 224 of a box can comprise a seal that is impermeable to moisture.

In accordance with embodiments of the present disclosure, a printer may be used to print graphics, labels and/or other printed material on the continuous sheet of paper prior to the paper being cut, creased, folded, and otherwise processed by the various machine steps of the disclosure. The paper having a printed graphic may then be indexed prior to being cut, creased, folded, and otherwise processed by the various machine steps of the disclosure. One having skill in the art will appreciate that a printer may be inserted in the manufacture process at various points in the process including between the paper rolls 104 and the folding plow 112, between the folding plow 112 and the gluing station 116, between the gluing station 116 and the cutting station 120, and after the cutting station 120. A printer may also be integrated with another component, such as with a folding plow 112. One having skill in the art will appreciate that the aspect of the present disclosure that permits the use of a thin substrate permits flexibility in positioning the inline printer. Printer is meant to include single-pass or multi-pass single or multi-color apparatus, and may also include devices that apply engraving, carving, branding, stamping, embossing and watermark imprinting.

Retail boxes made in accordance with embodiments of the present disclosure are strong due to the presence of four double ply sides. The result of the two composite, double-ply sides 412 having substantially complete-coverage glue, is that its resulting composite wall strength of the box is more than the aggregate of the components. This allows boxes to be manufactured from thinner paper and/or other materials than is possible with conventional methods. Conventional methods use thicker substrates including paper, board, paperboard, corrugated fiberboard and containerboard. Accordingly, less material is used to make a box of the present disclosure than a conventional box of equivalent or greater strength. This leads to a less wasteful and more environmentally friendly product. In addition, the corners of the assembled box may feature three or four ply portions, to provide sealing and increased strength at the corners of the box. Although sometimes referred to herein as a retail box, a box created by a method or apparatus in accordance with embodiments of the present invention is not restricted to any particular application or use.

Retail boxes made in accordance with embodiments of the present disclosure from substrate 105 material that is impermeable to moisture, and that have been sealed at the corners 904 of the box 124, can be used as a container for goods or materials that are preferably protected from contact with the ambient air and/or moisture, at least during transport and/or storage. For example, food, such as cereals, grains, pastas, flour, sugar or other dry goods can be transported and stored in boxes 124 as disclosed herein. Moreover, separate inner liners or bags are not required in order to provide a complete seal against the entry of moisture and/or ambient air, or to prevent the leakage of the product out of the box 124. As further examples, items that are often packaged in a plastic tray or other structure for preventing or reducing crumbling, such as cookies and crackers, and then sealed in a bag, can be packaged in a box 124 in accordance with embodiments of the present invention. As can be appreciated by one of skill in the art after consideration of the present disclosure, embodiments of the present invention can therefore provide methods and systems for transporting and/or storing food or other items that are preferably sealed against moisture and/or the ambient environment, using less materials then other packaging techniques.

The foregoing discussion of the disclosure has been presented for purposes of illustration and description. Further, the description is not intended to limit the invention to the form disclosed herein. Consequently, variations and modifications commensurate with the above teachings within the skill or knowledge of the relevant art are within the scope of the present disclosure. The embodiments described herein above are further intended to explain the best mode presently known of practicing the disclosure and to enable others skilled in the art to utilize the invention in such or in other embodiments and with the various modifications required by the particular application or use of the invention. It is intended that the appended claims be construed to include alternative embodiments to the extent permitted by the prior art.

What is claimed is:

1. A folding carton, comprising:

a single ply first half-box formed from a blank;

a single ply second half-box formed from a blank, wherein the single ply second half-box is opposite from the single ply first half-box;

a first at least two ply side, including a first portion of the single ply first half-box bonded to a first portion of the single ply second half-box;

a second at least two ply side, including a second portion of the single ply first half-box bonded to a second portion of the single ply second half-box, wherein the second at least two ply side is opposite from the first at least two ply side;

a third at least two ply side, including a third portion of the single ply first half-box bonded to a third portion of the single ply second half-box;

a fourth at least two ply side, including a fourth portion of the single ply first half-box bonded to a fourth portion of the single ply second half-box, wherein the fourth at least two ply side is opposite from the third at least two ply side;

a first dust flap and a second dust flap extending from the first portion of the single ply first half-box, the second portion of the single ply first half-box, the first portion of the single ply second half-box, and the second portion of the single ply second half-box;

wherein the first dust flap and the second dust flap are configured to provide two dust flap-sized, three ply areas on the first at least two ply side, the second at least two ply side, the third at least two ply side, and the fourth at least two ply side; and wherein adjacent three ply areas are positioned at an intersection of the first at least two ply side and the third at least two ply side, an intersection of the first at least two ply side and the fourth at least two ply side, an intersection of the second at least two ply side and the third at least two ply side, and an intersection of the second at least two ply side and the fourth at least two ply side.

2. The folding carton of claim 1, further comprising:

a first layer of a bonding agent that bonds the first portion of the single ply first half-box to the first portion of the single ply second half-box;

wherein the first layer of the bonding agent is a pattern coating, wherein the first portion of the single ply first half-box is adjacent to the first portion of the single ply second half-box, wherein the first layer of said bonding agent is on substantially all of a first surface of the first portion of the single ply first half-box and a second surface of the first portion of the single ply second half-box.

3. The folding carton of claim 2, further comprising a second layer of the bonding agent that bonds the second portion of the single ply first half-box to the second portion of the single ply second half-box, wherein the second layer of said bonding agent is a pattern coating, wherein the second portion of the single ply first half-box is adjacent to the second portion of the single ply second half-box, wherein the second layer of the bonding agent is on substantially all of a first surface of the second portion of the single ply first half-box and a second surface of the second portion of the single ply second half-box.

4. The folding carton of claim 1, wherein each of the first at least two ply side and the second at least two ply side includes a side flap of each of the single ply first half-box and the single ply second half-box, wherein each of the at least third and fourth sides includes one end flap of each of the single ply first half-box and the single ply second half-box.

5. The folding carton of claim 1, wherein the single ply first half-box and the single ply second half-box are moisture impermeable.

6. The folding carton of claim 1, further comprising:

a sealing material, wherein each corner of the folding carton is sealed by the sealing material.

7. The folding carton of claim 1, wherein the single ply first half-box and the single ply second half-box are formed from blanks of a pliable material that is less than 40 mils thick.

8. A folding carton, comprising:

a first half-box formed from a blank with a thickness less than 40 mils, including:

first and second side flaps;

first and second end flaps;

a first, a second, a third, and a fourth dust flap;

a second half-box formed from a blank with a thickness less than 40 mils, wherein the thicknesses of the first half-box and the second half-box are the same, including:

first and second side flaps;

first and second end flaps;

a bonding agent, wherein the first side flap of the first half-box is bonded to the first side flap of the second half-box to create a first two-ply side, and wherein the second side flap of the first half-box is bonded to the second side flap of the second half-box to create a second two-ply side and wherein the first, the second, the third and the fourth dust flaps remain unbonded.

9. The folding carton of claim 8, wherein the first end flap of the first half-box is bonded to at least a portion of the first end flap of the second half-box to create first at least two ply end.

10. The folding carton of claim 8, wherein the bonding agent is on substantially all of a first surface of the first side flap of the first half-box and a second surface of the first side flap of the second half-box.

11. The folding carton of claim 8, wherein the first half-box and the second half-box are moisture impermeable.

12. The folding carton of claim 8, wherein a material of the first half-box and the second half-box is plastic.

13. The folding carton of claim 8, wherein a material of the bonding agent is selected from the group consisting of a glue, an epoxy, a resin, a cement and an adhesive.

14. The folding carton of claim 9, further comprising:

a fifth, a sixth, a seventh, and an eighth dust flap positioned on the second half-box;

wherein the dust flaps are configured to provide two dust flap-sized, at least three ply areas on each of the first at least two ply end, and a second at least two ply end formed from the second end flap of the first half-box and the second end flap of the second half-box.

* * * * *